US005578996A

United States Patent [19]

Watson et al.

[11] Patent Number: 5,578,996

[45] Date of Patent: Nov. 26, 1996

[54] LONG LIFE DETECTOR

[75] Inventors: Kalvin Watson; Thomas W. Kondziolka, both of Chicago, Ill.

[73] Assignee: BRK Brands, Inc., Aurora, Ill.

[21] Appl. No.: 344,744

[22] Filed: Nov. 23, 1994

[51] Int. Cl.[6] ..... G08B 17/10

[52] U.S. Cl. ..... 340/628; 340/629; 340/630; 340/632; 340/693; 200/61.08; 200/300

[58] Field of Search ..... 340/628, 629, 340/630, 693, 632; 200/61.08, 200, 333, 334

[56] References Cited

U.S. PATENT DOCUMENTS

| | | | |
|---|---|---|---|
| 2,985,741 | 5/1961 | Ellmann | 200/61.08 |
| 4,688,021 | 8/1987 | Buck et al. | 340/521 |
| 4,901,056 | 2/1990 | Bellavia et al. | 340/514 |
| 5,359,168 | 10/1994 | Cunningham | 200/300 |
| 5,444,434 | 8/1995 | Serby | 340/628 |

OTHER PUBLICATIONS

Kodak & Dicon system team up to promote new long-life Lithium batteries and smoke detectors. New release, Dec. 1988.

*Primary Examiner*—Jeffery Hofsass
*Assistant Examiner*—Julie B. Lieu
*Attorney, Agent, or Firm*—Dressler, Goldsmith Milnamow & Katz, Ltd.

[57] ABSTRACT

A long life, surface mountable ambient condition detector includes a non-replaceable battery for the purpose of providing power to the detector. The detector includes an activation switch mechanism having a one-time, or single use turn-on characteristic. The activation switch mechanism switches the battery once from a non-conducting state to a state of electrical conduction with a control unit of the detector. The switch mechanism may include a frangible member for switching the battery from the non-conducting state to the electrical conducting state. Until the detector has been energized, the frangible member blocks mounting of the detector on the surface.

23 Claims, 4 Drawing Sheets

LONG LIFE DETECTOR

FIELD OF THE INVENTION

This invention relates to condition detectors having a one-time activation switch mechanism. More particularly, the invention relates to long-life ambient condition detectors having a non-replaceable battery for the purpose of powering the detector which is activated by a one-time activation switch mechanism.

BACKGROUND

Condition detectors such as smoke, gas, heat or fire detectors are commonly found today in buildings of all types. Many municipalities require installation of such detectors in buildings. Some of these detectors are AC-powered. Others are battery-powered. Some include a combination of AC power and battery backup power.

Battery-powered detectors, while very convenient and easy to install, have suffered from the drawback that a user of the building might not realize the unit needs a battery or that battery power may be low. Typically, such batteries are merely replaced by the user. Detectors commonly are powered by standard dry cell or alkaline type batteries, such as nine-volt batteries.

To assure the effectiveness of the batteries, many detectors have audible alarms to indicate low battery power, or test circuits to periodically test the battery power. Nevertheless, such detectors require that batteries be periodically replaced in order for the detector to properly operate. Unfortunately, users do not always have spare batteries readily available, and often detectors will go without power until a battery can be located and placed in the detector.

Thus, there continues to be a need for a cost effective and reliable detector having a battery with an extended life.

SUMMARY OF THE INVENTION

A sealed, ambient condition detector having no user accessible parts, and being disposable is disclosed. The detector includes a sensor, such as a gas, smoke, or fire sensor, and a control unit coupled to the sensor.

The detector is powered by an energy source which is non-removably coupled to the control unit. The energy source is a long-life battery unit. Preferably, expected battery life will exceed five years in normal operation The detector includes an activation switch mechanism having a single use turn-on or activation characteristic. The activation switch switches the energy source once from a non-conducting state into electrical conduction with the control unit.

In a preferred embodiment, the single-use activation switch mechanism includes a frangible member for switching the energy source from the non-conducting state into electrical conduction. The frangible member may or may not be removable from the detector.

Numerous other advantages and features of the present invention will become readily apparent from the following detailed description of the invention and the embodiments thereof.

DETAILED DESCRIPTION OF THE PREFERRED EMBODIMENTS

Figure 1:
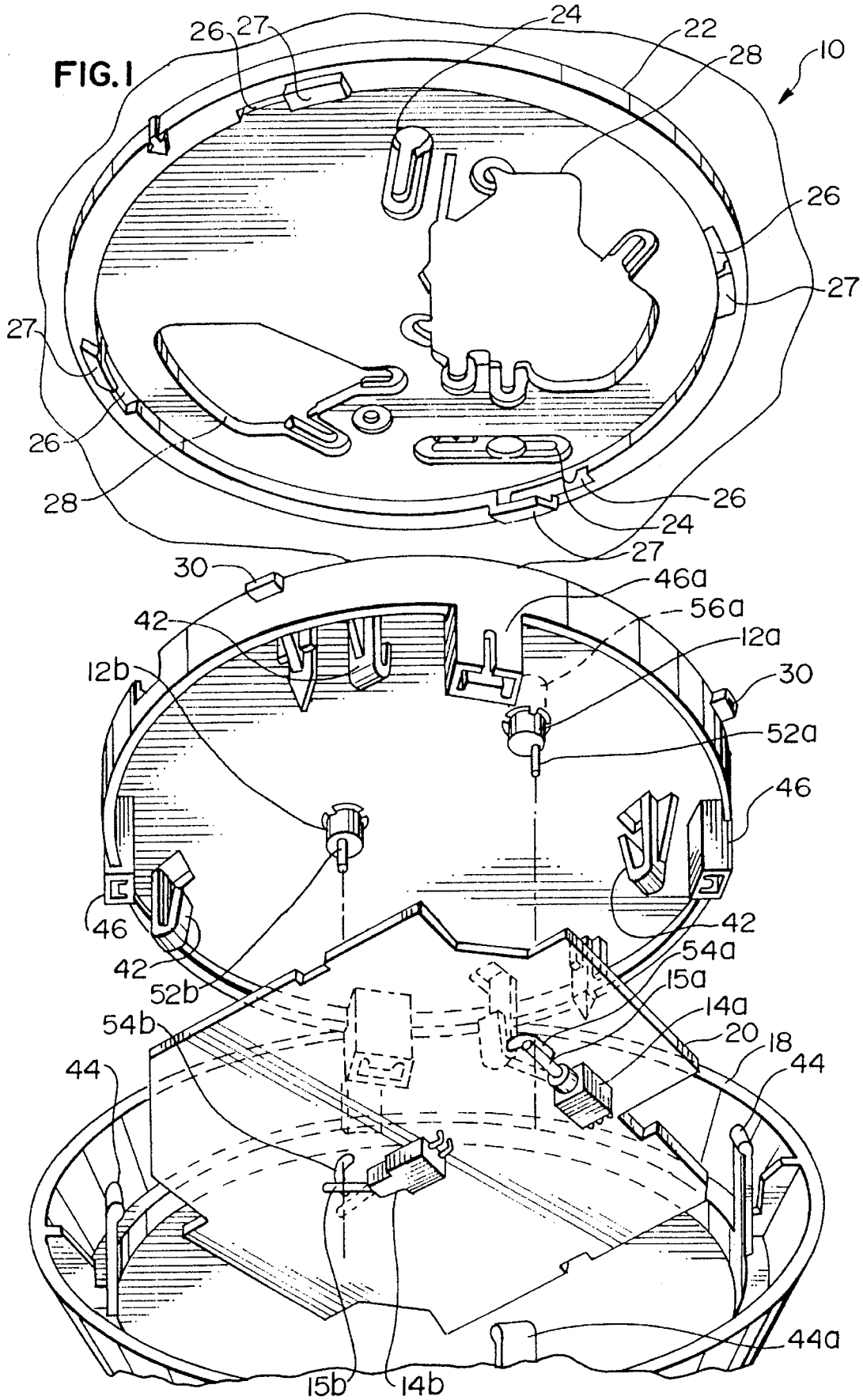
FIG. 1 is an exploded perspective view of one embodiment of a detector embodying the principles of the present invention.

While this invention is susceptible of embodiment in many different forms there are shown in the drawings and will be described herein in detail specific embodiments thereof with the understanding that the present disclosure is to be considered as an exemplification of the principles of the invention and is not intended to limit the invention to the specific embodiment illustrated.

A first embodiment of a long-life battery-powered detector 10 is disclosed in FIGS. 1–5, which incorporates a one-time activation switch mechanism. The detector 10 has a switch mechanism including rotatable, frangible or breakaway members 12*a*, 12*b* and associated single-pole, single-throw (SPST) energizing and deenergizing switches 14*a* and 14*b* respectively.

Switch 14*a* provides one-time activation of the detector 10 when it is placed in service. Switch 14*b* discharges and deactivates the detector 10 at the end of its useful service life.

The detector, as shown in FIG. 1, includes a base 16, a cover 18, and an electrical circuit board 20, which includes the electronics 20*a* necessary for operation of the detector. The detector 10 may be mountable to a surface, such as a wall, by a mounting flange or bracket 22.

The mounting flange 22 typically includes slotted holes 24 for engaging fasteners (not shown) to secure the flange 22 to the surface. The flange 22 also includes slotted channels 26 formed by L-shaped projections 27, for rotatably mounting the base 16 thereto. In the embodiment shown in FIG. 1, the mounting flange also includes material reducing openings 28 therein.

The base 16 further includes projections 30 which extend radially outwardly therefrom for engaging the slotted channels 26 in the mounting flange 22, and removably securing the base 16 to the flange 22.

Figure 2:
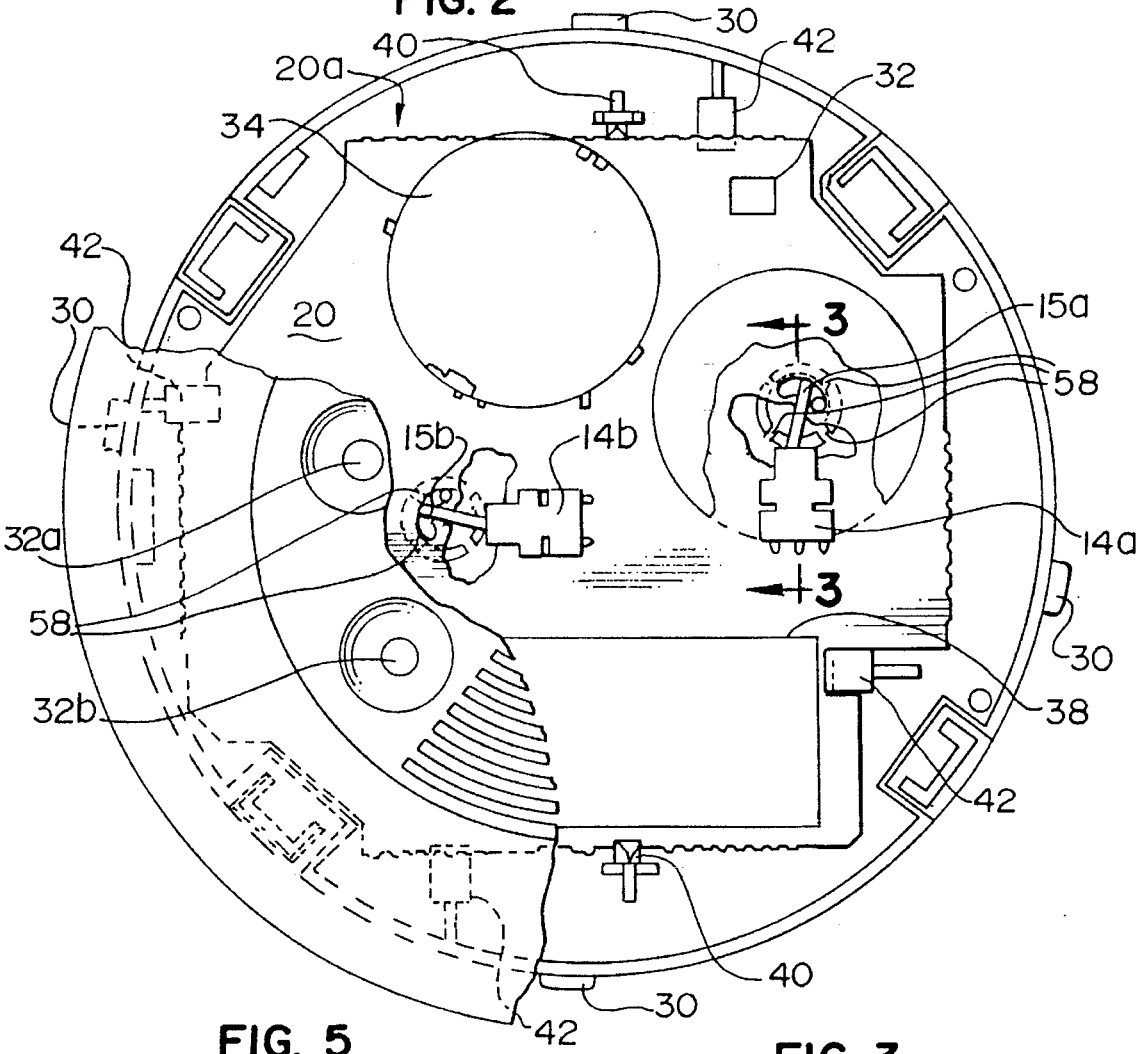
FIG. 2 is a partially broken away, top plan view of the detector of FIG. 1.
Figure 5:
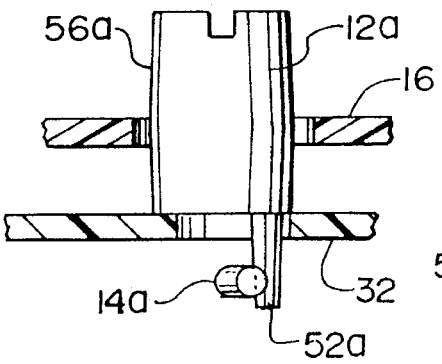
FIG. 5 is a partial cross-sectional view of the switching mechanism, the view being rotated about 90° from that shown in FIG. 3.
Figure 3:
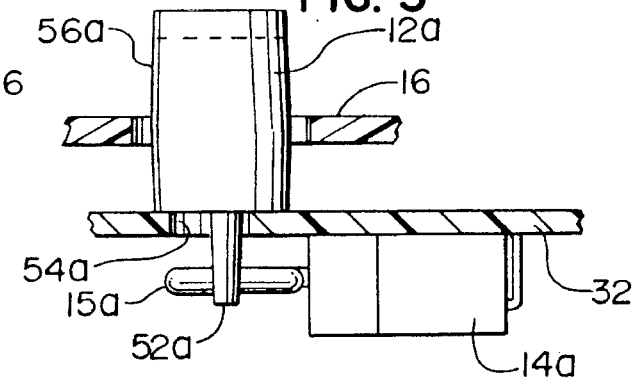
FIG. 3 is a partial cross-sectional view taken along line 3—3 of FIG. 2.
Figure 4:
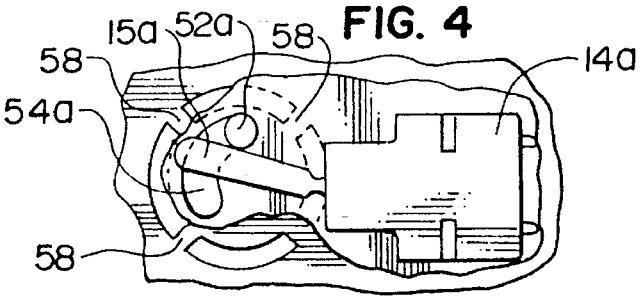
FIG. 4 is a partial top plan view illustrating one embodiment of a switching mechanism of the present invention.

As best seen in FIG. 2, the base 16 supports the electronics 20*a* of the detector 10 including the control unit 32, audible output device 34, sensor 36, and permanently connected battery unit 38.

The circuit board 20 is aligned in, and secured to, the base 16 by a plurality of aligning members 40 and clips 42. The aligning members 40 and clips 42 provide for proper alignment of the board 20 within the detector 10, and further secure the board 20 in place therein.

The detector 10 also includes a cover 18 which has downwardly projecting retaining clips 44 to engage upstanding clip receptacles 46 formed in the base 16. Because proper orientation of the cover relative to the base 16 is necessary, the clips 44 and receptacles 46 are formed such that a clip 44*a* and a receptacle 46*a* will engage only each other and will not engage the other clips 44 or receptacles 46.

The detector 10 may also include test or silencing buttons 32*a* or 32*b* or indicators 50 mounted thereon to accommodate circuitry for testing the detector 10 to determine whether it is operable, silencing the detector 10 when it is in the alarm condition, or to provide visual indication of battery power by means of a light emitting diode 50.

Unlike known detectors, a detector 10 of the present invention is a sealed unit. That is, the base 16 and cover 18 are sealed one with the other during manufacture. Thus, the circuitry and components of the detector 10 are not user accessible.

Also unlike known detectors, the detector 10 incorporates a long-life battery unit 38, which is not replaceable by the user. Such batteries may be designed to provide up to 10 years of service life for the detector.

Examples of such long life battery units 38 include a single, 9-volt lithium battery or alternatively, three 3-volt lithium batteries configured to produce a nine-volt output. Lithium based batteries, such as lithium chloride, lithium manganese, and lithium poly-carbon monofloride may be used to provide such long life capabilities.

Moreover, the detector 10 is not limited to batteries providing a nine-volt output. The detector 10 may be provided with, for example, a 3.3 volt battery, and circuitry designed accordingly, to operate on a 3.3 volt circuit. It is to be understood that other voltages and battery arrangements are within the scope of the present invention.

Underwriters Laboratories ("UL") requires that power containing devices, such as detectors, be packaged and shipped in a deactivated state. The detector 10 of the present invention meets the UL requirement for shipment in a deactivated state, in a sealed unit, while providing one-time activation of the detector 10. The detector 10 is activated by the user, prior to installation.

As previously discussed, and as best seen in FIG. 1, the base 16 is formed with frangible members 12*a* and 12*b*. Each of the members 12*a* and 12*b* is formed with a stub or post 52*a* or 52*b*, respectively, which projects upward from its respective member 12*a*, 12*b*, inward of the detector.

The stubs 52*a* and 52*b* extend through curvilinear slots 54*a* and 54*b* formed in the board 20. Mounted to the board 20, adjacent to the curvilinear slots, 54*a*, 54*b*, are the activating switch 14*a* and end-of-life deactivating switch 14*b*.

Various types of switches may be used. In the embodiments shown in FIGS. 1 through 5 and 8, toggle-type switches are shown to illustrate the principles of the present invention. It is to be noted that in this embodiment frangible member 12*a* has a rear portion 56*a* which extends rearward of the base 16 as further discussed below.

The configuration in which the stubs 52*a* and 52*b* extend through the curvilinear slots 54*a* and 54*b* permits the stubs 52*a* and 52*b* to coact with the activation switch 14*a* and deactivation switch 14*b*, respectively.

The frangible members 12*a* and 12*b* are accessible from the back or underside of the base 16. Each of the members 12*a* and 12*b* is connected to the base 16 by bridge-like members 58. When the frangible members 12*a* and 12*b* are rotated or turned as by a screwdriver or like device, the bridge-like members break.

Continued turning of the frangible members 12*a* and 12*b* traverses the stubs 52*a* and 52*b* through the curvilinear slots 54*a* and 54*b*, thereby moving respective actuating arms 15*a*, 15*b* of the energizing or deenergizing switches 14*a*, 14*b*, respectively. The frangible members 12*a* and 12*b* can then be removed from the detector 10 and discarded. The members 12*a* and 12*b* are not intended to be reused. The presence or absence of the members 12*a* and 12*b* provides visual indication of switch 14*a*, 14*b* and 15*a*, 15*b*, status.

The detector 10 is packaged and shipped to users in a deenergized state. To energize the detector 10 for use, the frangible member 12*a* is turned, as by a screwdriver or like device, in a clockwise direction. The force of turning member 12*a* breaks the bridge-like connections 58. Continued turning of the member 12*a* moves stub 52*a* through slot 54*a* thereby moving switch handle 15*a* and placing switch 14*a* in a closed circuit or conducting state.

Moving switch 14*a* into the energizing or "on" position, closes a circuit which provides power to the detector 10. Once the detector is energized, member 12*a* is removed from the detector 10, and discarded. The detector 10 is then mounted to a surface, such as by the mounting flange 22.

The rear portion 56*a* extends rearward beyond the base and while in place, interferes with the base 16 mounting to the mounting flange 22. Thus, until the detector 10 has been turned on and the member 12*a* is removed from the base 16, the base 16 cannot be mounted to the surface mounted mounting flange 22. This reduces the possibility that an unactivated detector will be installed.

Once the detector has reached its useful life, which is contemplated to be about ten years, the detector 10 will emit a low battery power signal. Methods and designs for providing such a low battery power signal are well known in the art and are not part of this invention.

The detector 10 is then removed from the mounting flange 22. The frangible member 12*b* which activates the deactivating switch 14b is rotated in the same manner as member 12*a*.

A screwdriver or like device is used to turn or rotate member 12*b* in a clockwise direction. This movement breaks the bridge-like connections 58 which connect member 12*b* to the base 16. Continued turning of the member 12*b* brings stub 52*b* into contact with and moves switch handle 15*b* of the deenergizing switch 14*b* into the closed, or deenergized position. The deenergizing position of switch 14*b* "drains" the battery unit 38 of any remaining power.

As previously provided, the detector 10 is sealed and the battery unit 38 is non-removably coupled to the control unit 32. Therefore, at the end of the detector's service life, it is disposed of and a new detector is installed in its place.

Figure 6:
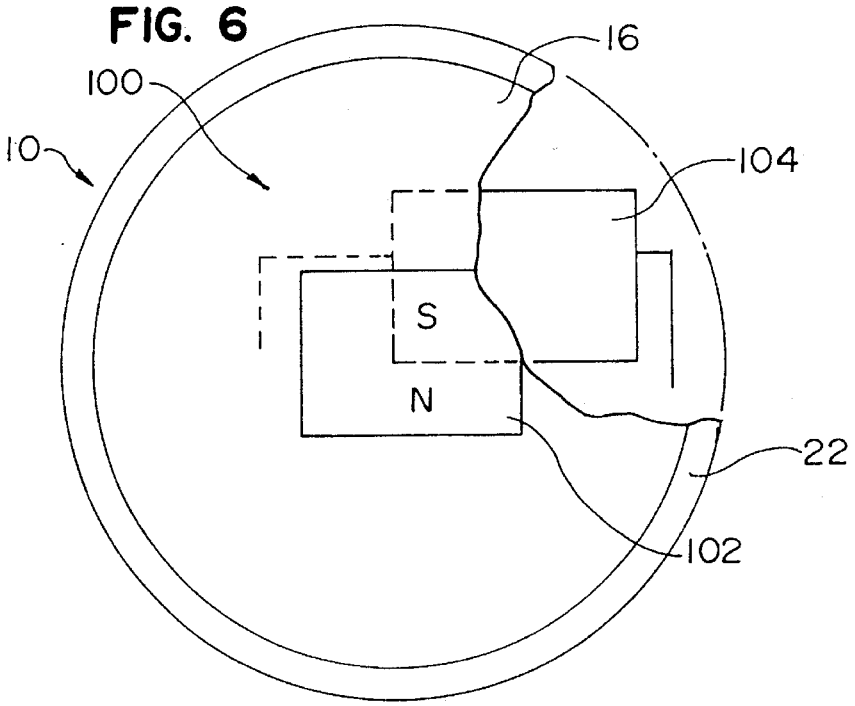
FIG. 6 is a top plan view of an alternate embodiment of a detector illustrating a read-relay arrangement.

Other embodiments of the one-time activation switch mechanism 12*a* are shown in FIGS. 6 through 9. FIG. 6 illustrates a reed-relay mechanism, shown generally at 100. A first relay portion 102, a magnet, is mounted to the mounting flange 22. A second relay portion 104, a relay body with closable contacts, is mounted to the base 16.

When the first and second relay portions 102 and 104 are brought into close proximity, one with the other, the relay contacts close and activate the detector 10.

Figure 7:
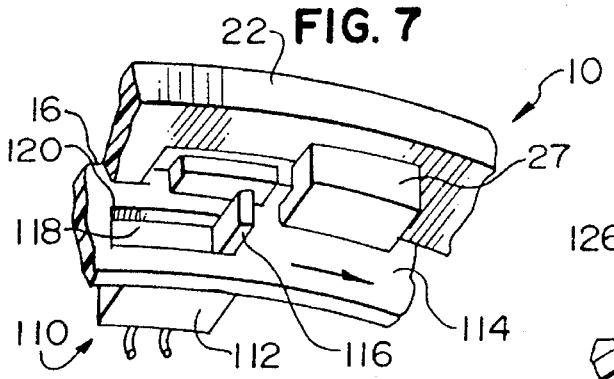
FIG. 7 is a partial perspective view of another alternate embodiment of the switch mechanism.

Another embodiment of a one-time activating switch mechanism 110 is illustrated in FIG. 7. In this embodiment, an activating switch 112 is located within the base 16, mounted inside the detector 10 to a wall portion 114 of the base 16. The switch 112 is a single use slide-switch, with at least a part of the stem portion 116 extending through a slot 118 formed in the sidewall 114.

In this embodiment, the detector 10 is activated by mounting the detector 10 to the mounting flange 22. When the base 16 is rotated to mount the base 16 to the flange 22, the stem portion 116 engages the L-shaped projection 27 and is moved into an activating position.

The stem portion 116 may be frangible. That is, once the base 16 is fully engaged with mounting flange 22, the stem portion contacts and end 120 of the slot 118, and the stem portion 116 is broken off from the switch 112. This configuration prevents inadvertent movement of the switch 112 if the base 16 is removed from the mounting flange 22. Alternatively, the switch 112 can include an internal rachet permitting a single movement of the arm 116.

Figure 8:
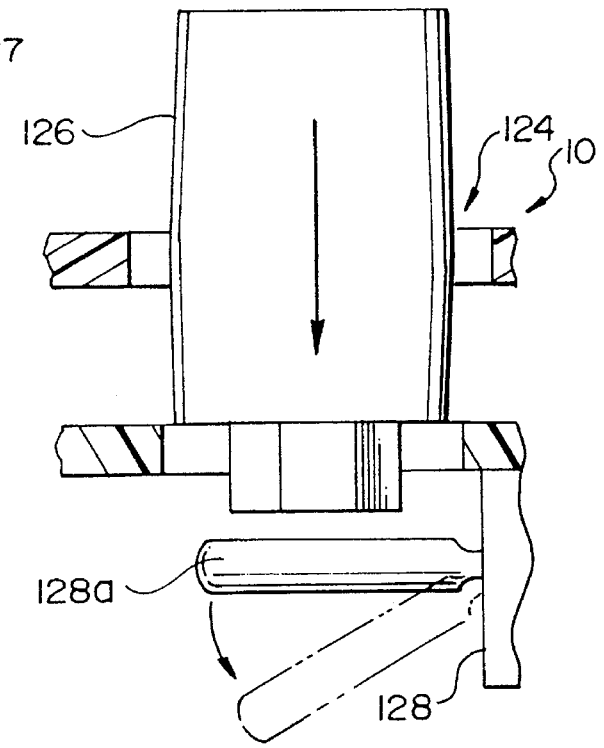
FIG. 8 is a partial cross-sectional view of yet another embodiment of the switch mechanism.
Figure 9:
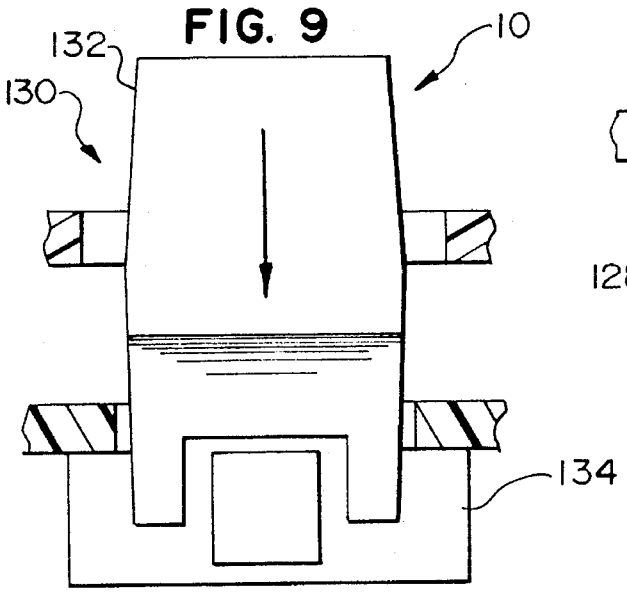
FIG. 9 is a partial cross-sectional view of still another embodiment of the switch mechanism.

FIGS. 8 and 9 illustrate other embodiments of a one-time activating switch mechanism. The mechanism 124 shown in FIG. 8 includes a frangible plunger-type member 126 which, when pushed inward of the base 16, engages a toggle-type activating switch 128. The member 126 moves a switch arm 128a from an open circuit to a closed circuit, activation condition. Similar to the embodiment illustrated in FIGS. 1 through 5, the plunger 126 can, but need not then be removed from the detector 10 and discarded.

The embodiment of the switch mechanism 130 illustrated in FIG. 9 also employs a plunger-type frangible member 132. When member 132 is pushed inward of the detector 10, it engages a slide-type activating switch 134. As with the previous embodiments, the plunger member 132 can then be removed from the detector 10 and discarded.

The various above noted embodiments provide for a single turn-on of the detector 10. Until the detector 10 has been turned on, it can not be mounted onto the bracket 22. The single use turn-on structures of the present invention can also be used with detectors which are directly mounted to a surface.

Figure 10:
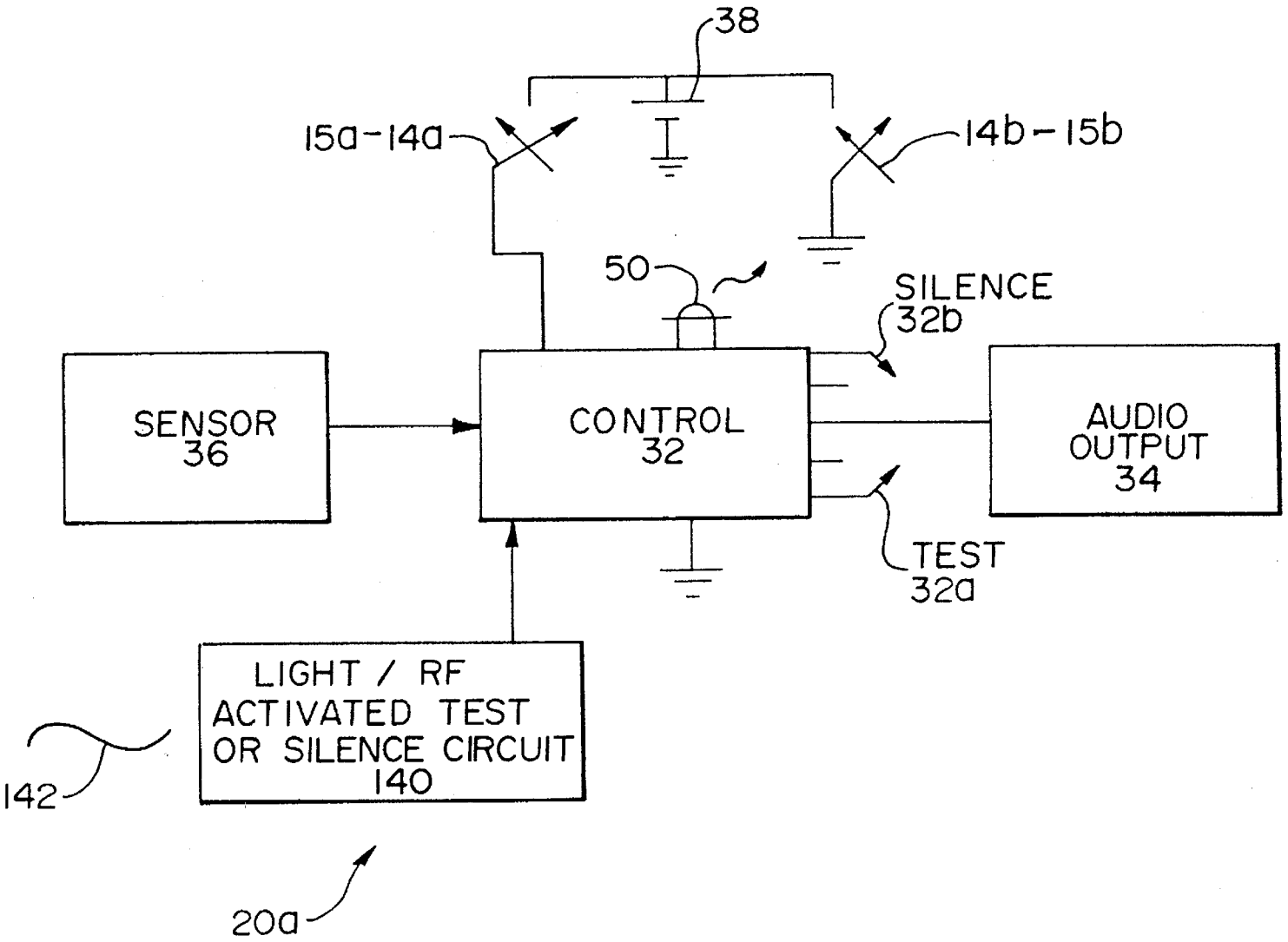
FIG. 10 is an exemplary circuit diagram of a detector embodying the present invention.

The detector 10 includes circuitry 20*a* as illustrated in FIG. 10. The circuitry 20*a* includes the sensor 36 coupled to the control unit 32. The control unit 32 could be a conventional integrated circuit of a type used with ambient condition detectors. The control unit 32 is in turn coupled to the audio output device or horn 34. The control unit 32 includes a test switch 32*a* which can be carried on the cover 18 for ready accessibility so that a user can easily test the detector 10.

For purposes of silencing nuisance alarms, a silence switch 32*b* coupled to the control unit 32 can also be carried on the cover 18. For remote activation, a light activated test or silencing circuit 140 can be provided coupled to the control unit 132. The circuit 140 can respond to remotely generated radiant or radio frequency energy 142 for purposes of either testing the unit 10 or silencing same.

The permanently installed battery 38 is coupled by a one-time turn on switch 14*a* to the control unit 32 as well as to any other circuitry as appropriate, and as would be understood by one skilled in the art. The end of life battery discharge switch 14*b* is coupled in parallel with the battery 38 for the purpose of completely discharging same when the detector has reached the end of its useful life, on the order of five to ten years.

A representative light-activated test or silencing circuit is disclosed in U.S. Pat. No. 4,827,244 entitled "Test Initiation Apparatus With Continuous Pulse Input".

If the output voltage of the battery 38 is not sufficient, a voltage double-type circuit can be included between the battery 38 and the remainder of the circuitry of the detector 10.

From the foregoing, it will be observed that numerous variations and modifications may be effected without departing from the spirit and scope of the novel concept of the present invention. It is to be understood that no limitation with respect to the specific embodiments illustrated herein is intended or should be inferred. It is, of course, intended to cover by the appended claims all such modifications as fall within the scope of the claims.

What is claimed is:

1. An ambient condition detector comprising:

a sensor;

a control unit coupled to said sensor;

an energy source non-removably coupled to said control unit; and a single use turn-on switch having a break-away control member wherein said energy source is switched once from a non-conducting state into electrical conduction with said control unit, wherein said sensor includes at least one of a smoke sensor and a gas sensor.

2. A detector as in claim 1 wherein said source includes at least one lithium-type or other technology-type battery.

3. A detector as in claim 1 wherein said switch includes a single use, movable control member.

4. A detector as in claim 3 wherein said control member is movable once from a first state to a second state.

5. A detector as in claim 4 wherein said source is not energizing said control unit when said control member is in said first state and wherein said control unit is electrically coupled to said source when said member has been moved to said second state.

6. A detector as in claim 1 wherein said switch includes an operable member which provides at least a visual indicator of switch status.

7. An ambient condition detector as in claim 1 which includes a single use energy discharge switch wherein said discharge switch can be switched once from an open circuit to a closed circuit condition for the purpose of discharging said energy source.

8. An ambient condition detector comprising:

a sensor;

a control unit coupled to said sensor;

an energy source coupled to said control unit; and a single use turn-on switch having a break-away control member wherein said energy source is switched once from a non-conducting state into electrical conduction with said control unit, wherein said sensor includes at least one of a smoke sensor and a gas sensor, and wherein said control unit includes circuitry, remotely activatable, for testing said control unit.

9. An ambient condition detector comprising:

a sensor;

a control unit coupled to said sensor;

an energy source non-removably coupled to said control unit;

a single use turn-on switch, said switch including a single use, movable control member, wherein said energy source is switched once from a non-conducting state into electrical conduction with said control unit; and a mounting flange for mounting said detector to a surface and wherein said switch includes a portion extending therefrom which, until moved, interferes with said mounting flange.

10. An ambient condition detector mountable on a surface, comprising:

a sensor;

a control unit coupled to said sensor;

an energy source non-removably coupled to said control unit; and a single use turn-on switch, said switch including a single use, movable control member, wherein said energy source is switched once from a non-conducting state into electrical conduction with said control unit;

wherein said switch includes a portion extending therefrom which, until moved, keeps said detector from being mountable on the surface.

11. An ambient condition detector comprising:

a sensor;

a control unit coupled to said sensor;

an energy source non-removably coupled to said control unit;

a housing;

a single use turn-on switch having a frangible operating member, wherein said energy source is coupled to at least said control unit in response to said single use turn on switch being moved from a first state to a second state; and a single use discharge switch coupled to said energy source for fully discharging said energy source, wherein said single use turn-on switch protrudes from said housing and interferes with mounting said detector when said single use turn-on switch is in said first state and does not interfere with mounting said detector when said switch is in said second state.

12. A detector as in claim 11 further including a mounting flange for mounting said detector to a surface.

13. An ambient condition detector comprising:

a sensor;

a control unit coupled to said sensor;

an energy source non-removably coupled to said control unit;

a single use turn-on switch having a frangible operating member, wherein said energy source is coupled to at least said control unit in response to said single use turn on switch being moved from a first state to a second state;

a single use discharge switch coupled to said energy source for fully discharging said energy source;

a mounting flange;

wherein said single use turn-on switch includes a portion extending therefrom which, when in place, interferes with mounting the detector to said mounting flange.

14. A detector as in claim 13 wherein said mounting flange includes means for separating said frangible operating member from said single use turn on switch.

15. A detector with an extended usable life in excess of 5 years comprising:

a sealed housing which defines an interior, substantially closed region;

a sensor;

a control element coupled to said sensor and carried within said housing;

a non-replaceable battery carried within said housing;

a switch carried within said housing coupled between said element and said battery wherein said switch carries an operable member which is accessible outside of said region, wherein said switch has a first, inoperative state and a second, operative state, wherein said battery is electrically coupled to said element in response to said switch being moved from said first to said second state and wherein said operable member provides at least a visual indication of said state of said switch, and wherein said operable member includes one of a break away control member and a single use, movable control member, and wherein said operable member interferes with mounting said detector when said switch is in said first, inoperative state and does not interfere with mounting said detector when said switch is in said second, operative state.

16. An ambient condition detector comprising:

a sensor;

a control unit coupled to said sensor;

an energy source coupled to said control unit; and a single use turn-on switch having a break-away control member wherein said energy source is switched once from a non-conducting state into electrical conduction with said control unit, wherein said sensor includes at least one of a smoke sensor and a gas sensor.

17. A detector as in claim 16 wherein said energy source is non-removably coupled to said control unit.

18. A detector as in claim 16 wherein said switch includes a single use, movable control member.

19. A detector as in claim 16 wherein said control member is movable once from a first state to a second state.

20. An ambient condition detector comprising:

a sensor;

a control unit coupled to said sensor;

an energy source coupled to said control unit;

a housing;

a single use turn-on switch having a frangible operating member, wherein said energy source is coupled to at least said control unit in response to said single use turn on switch being moved from a first state to a second state; and a single use discharge switch coupled to said energy source for fully discharging said energy source, wherein said single use turn on switch protrudes from said housing and interferes with mounting said detector when said single use turn on switch is in said first state and does not interfere with mounting said detector when said switch is in said second state.

21. A detector as in claim 20 wherein said energy source is non-removably coupled to said control unit.

22. A detector as in claim 20 including a mounting flange for mounting said detector to a surface.

23. A detector as in claim 22 wherein said mounting flange includes means for separating said frangible operating member from said single use turn on switch.

* * * * *